US005352140A

United States Patent [19]

Schriner

[11] Patent Number: 5,352,140

[45] Date of Patent: Oct. 4, 1994

[54] MOTORBOAT THRUST TUBE

[76] Inventor: Roy A. Schriner, 202 E. Brier St., Dodge City, Kans. 67801

[21] Appl. No.: 120,070

[22] Filed: Sep. 13, 1993

[51] Int. Cl.[5] ..... B63H 1/16

[52] U.S. Cl. ..... 440/67

[58] Field of Search ..... 440/66, 67, 71, 900; 114/150, 166

[56] References Cited

U.S. PATENT DOCUMENTS 899,359 9/1908 Wadagaki ..... 440/67

2,551,371 5/1951 Grigg ..... 440/71

4,600,394 7/1986 Dritz ..... 440/900

FOREIGN PATENT DOCUMENTS 1513548 1/1968 France ..... 440/67

*Primary Examiner*—Jesus D. Sotelo

*Attorney, Agent, or Firm*—E. Michael Combs

[57] ABSTRACT

A thrust tube is arranged for mounting about the propeller of an associated motorboat unit, as the thrust tube is fixedly secured to the lower housing unit of such a motor unit.

3 Claims, 4 Drawing Sheets

MOTORBOAT THRUST TUBE

BACKGROUND OF THE INVENTION

1. Field of the Invention

The field of invention relates to outboard motor structure, and more particularly pertains to a new and improved motorboat thrust tube arranged for coaxially positioning medially thereof the thrust propeller of an associated outboard motor unit within the thrust tube of the invention.

2. Description of the Prior Art

Tube structure arranged relative to an outboard motor unit is indicated in the prior art in the U.S. Pat. No. 4,680,017, wherein the propeller is positioned in adjacency to the rear distal end of the motor unit, whereas the instant invention positions the propeller medially thereof in a coextensive relationship relative to the tube structure to provide for enhanced thrusting of the fluid between the propeller and the tube structure and in this respect, the present invention substantially fulfills this need.

SUMMARY OF THE INVENTION

In view of the foregoing disadvantages inherent in the known types of motorboat apparatus now present in the prior art, the present invention provides a motorboat thrust tube wherein the same is arranged to mount the propeller of a motorboat medially of the associated thrust tube. As such, the general purpose of the present invention, which will be described subsequently in greater detail, is to provide a new and improved motorboat thrust tube which has all the advantages of the prior art outboard motor apparatus and none of the disadvantages.

To attain this, the present invention provides a thrust tube arranged for mounting about the propeller of an associated motorboat unit, as the thrust tube is fixedly secured to the lower housing unit of such a motor unit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motorboat thrust tube which has all the advantages of the prior art motorboat apparatus and none of the disadvantages.

It is another object of the present invention to provide a new and improved motorboat thrust tube which may be easily and efficiently manufactured and marketed.

It is a further object of the present invention to provide a new and improved motorboat thrust tube which is of a durable and reliable construction.

An even further object of the present invention is to provide a new and improved motorboat thrust tube which is susceptible of a low cost of manufacture with regard to both materials and labor, and which accordingly is then susceptible low prices of sale to the consuming public, thereby making such motorboat thrust tubes economically available to the buying public.

Still yet another object of the present invention is to provide a new and improved motorboat thrust tube which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
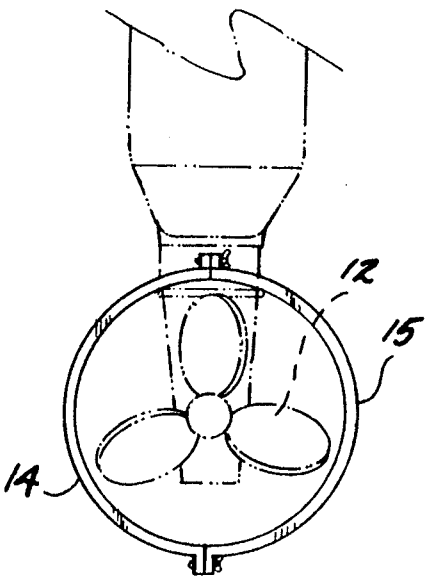
FIG. 2 is an orthographic view, taken along the lines 2—2 of FIG. 1 in the direction indicated by the arrows.
Figure 1:
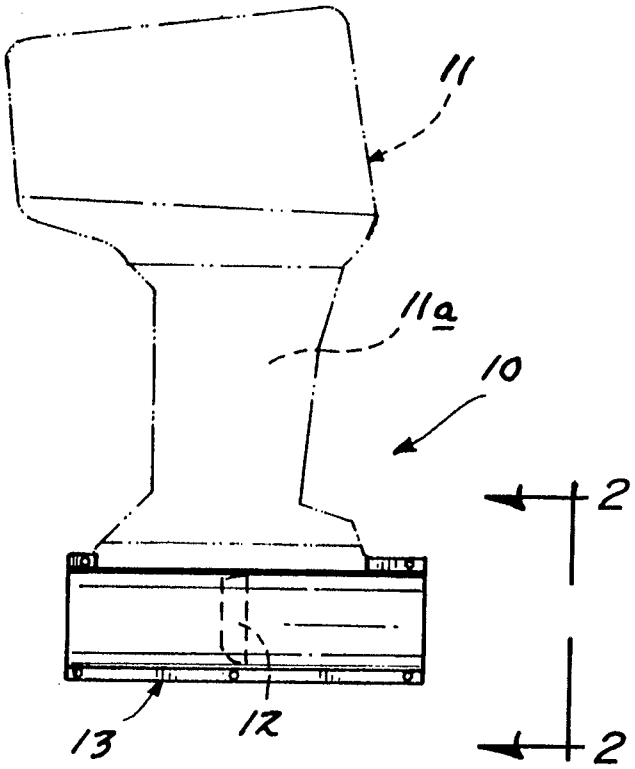
FIG. 1 is an orthographic side view of the invention.
Figure 3:
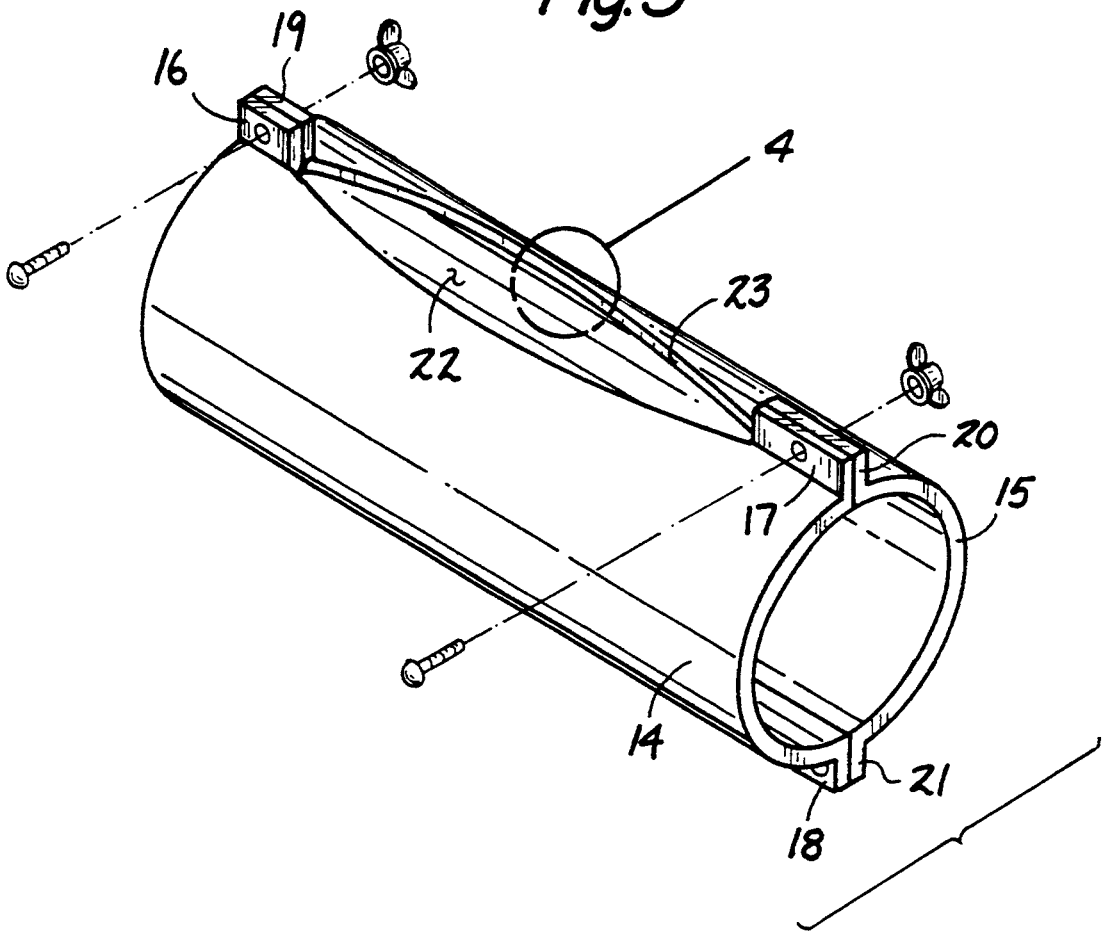
FIG. 3 is an isometric illustration of the tube structure.
Figure 4:
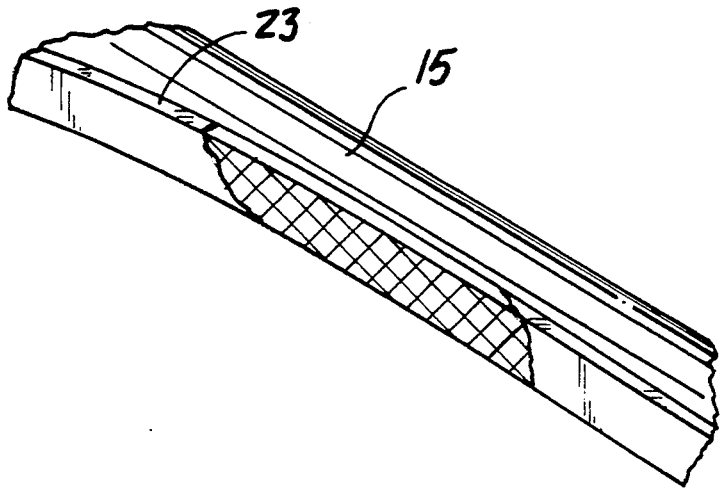
FIG. 4 is an enlarged orthographic view, partially in section, of the FIG. 3 as indicated.

With reference now to the drawings, and in particular to FIGS. 1 to 8 thereof, a new and improved motorboat thrust tube embodying the principles and concepts of the present invention and generally designated by the reference numeral 10 will be described.

More specifically, the motorboat thrust tube 10 of the instant invention essentially comprises in combination with an outboard motor unit 11, having a lower unit 11a, wherein a thrust propeller 12 is mounted to the lower unit in a known manner, such that a thrust tube 13 is mounted to the lower unit coaxially aligned with the thrust propeller 12, with the thrust propeller positioned medially of the thrust tube. The thrust tube 13 includes first and second semi-cylindrical shells 14 and 15 arranged for securement together, with the first shell having first shell first and second flanges 16 and 17 arranged for securement to second shell first and second flanges 19 and 20 respectively employing fasteners 26. A first shell third flange 18 is mounted to a second shell third flange 21 that are in a facing relationship diametrically opposed to the first and second shell first and second flanges. An opening 22 is directed into the thrust tube 13 to receive the lower unit as well as the propeller associated therewith, with a magnetic flange 23 mounted integrally to the second shell 15 oriented between the first and second flanges 19 and 20 for enhanced securement to the lower unit.

Figure 5:
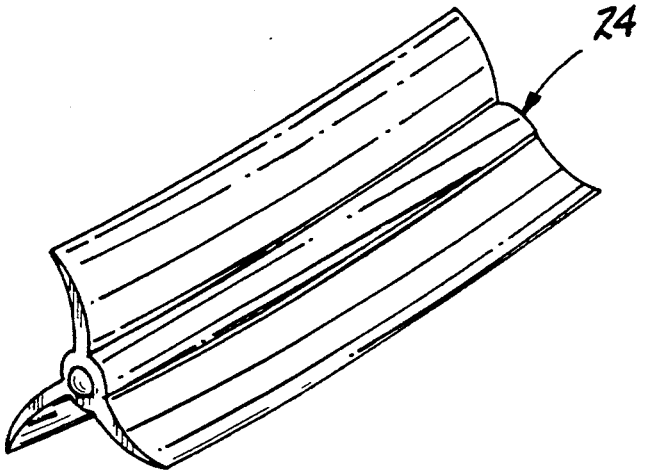
FIG. 5 is an isometric illustration of a preferred propeller unit employed by the invention.
Figure 6:
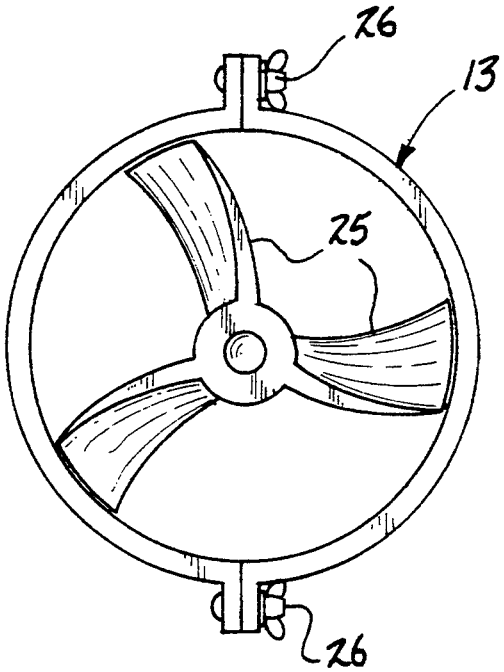
FIG. 6 is an orthographic end view of the thrust tube mounting the modified propeller structure.

The FIG. 5 indicates the use of a modified propeller 24 that is arranged for positioning coextensively throughout the thrust tube 13 from the forward end to the rearward end, with each of the blades of the propeller 24 formed of a helical construction defining helical blades 25.

Figure 7:
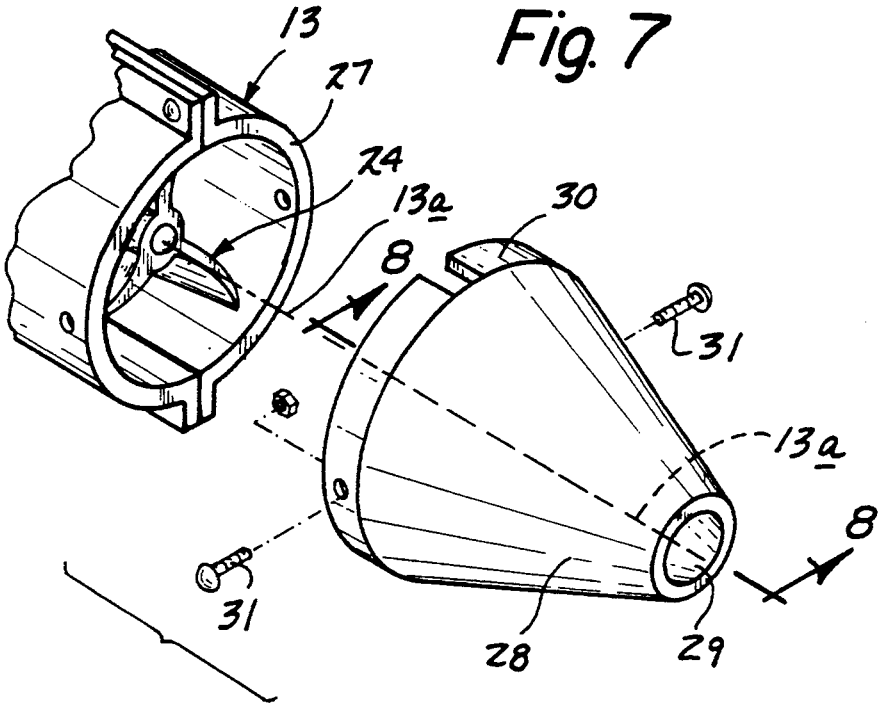
FIG. 7 is an isometric illustration of the invention employing a conical thrust end to the thrust tube.
Figure 8:
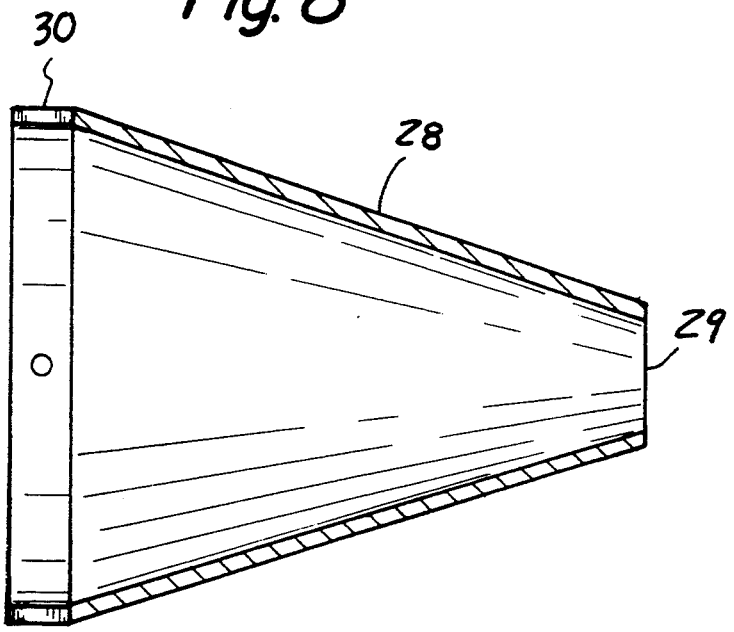
FIG. 8 is an orthographic view, taken along the lines 8—8 of FIG. 7 in the direction indicated by the arrows.

The FIGS. 7 and 8 indicates the optional employment of a conical nose 28, having a nose opening 29 coaxially aligned with the thrust tube axis 13*a*, as illustrated in FIG. 7. The opening 29 is spaced from the thrust tube rearwardmost end 27 to provide for enhanced velocity to fluid directed through the nose opening 29. A cylindrical flange 30 is arranged for securement about the thrust tube 13 employing further fasteners 31.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motorboat thrust tube, comprising in combination, an outboard motor unit having a thrust propeller, the thrust tube secured to the outboard motor unit in surrounding relationship relative to the thrust propeller, with the thrust tube symmetrically oriented about a predetermined axis, with the thrust propeller coaxially aligned relative to the predetermined axis and positioned medially of the thrust tube, and the thrust tube includes a first semicylindrical shell secured to a second semicylindrical shell, the first shell having a first shell first flange spaced from a first shell second flange, the second shell having a second shell first flange spaced from a second shell second flange, the first shell first flange secured to the second shell first flange, and the first shell second flange secured to the second shell second flange, the first shell including a first shell third flange, the second shell including a second shell third flange, with the first shell first flange secured to the second shell third flange, and a housing unit opening directed through the first shell and the second shell between the first shell first flange and the first shell second flange and the second shell first flange and the second shell second flange, and the second shell having a magnetic flange extending between the second shell first flange and the second shell second flange, with the magnetic flange arranged for securement to the outboard motor unit.

2. A thrust tube as set for in claim 1 wherein the thrust propeller is coextensively directed within the thrust tube.

3. A thrust tube as set forth in claim 2 wherein the thrust tube includes a thrust tube rearwardmost end, and a conical nose having a conical nose opening coaxially aligned with the predetermined axis, and the conical nose including a cylindrical flange extending from the conical nose spaced from the conical nose opening, with the cylindrical flange including fastening means for securement of the conical nose to the thrust tube adjacent the rearwardmost end.

* * * * *